US010265757B2

(12) United States Patent
Pyper et al.

(10) Patent No.: US 10,265,757 B2
(45) **Date of Patent: *Apr. 23, 2019**

(54) GUIDED KEEPER ASSEMBLY AND METHOD FOR METAL FORMING DIES

(71) Applicant: Standard Lifters, Inc., Grand Rapids, MI (US)

(72) Inventors: Joel T. Pyper, Grand Rapids, MI (US); Scott M. Breen, Marne, MI (US); Gordon L. Chaisson, Howell, MI (US); Jeremie J. Yoder, Grand Rapids, MI (US); Theodore A. McIntyre, Grandville, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 687 days.

This patent is subject to a terminal disclaimer.

(21) Appl. No.: 14/953,591

(22) Filed: Nov. 30, 2015

(65) Prior Publication Data

US 2016/0082499 A1 Mar. 24, 2016

Related U.S. Application Data

(60) Continuation of application No. 13/954,498, filed on Jul. 30, 2013, now Pat. No. 9,221,092, which is a (Continued)

(51) Int. Cl.
*B21D 37/04* (2006.01)
*B21D 37/12* (2006.01)

(Continued)

(52) U.S. Cl.
CPC ..... *B21D 37/12* (2013.01); *B21D 22/10* (2013.01); *B21D 37/02* (2013.01); *B21D 37/04* (2013.01);

(Continued)

(58) Field of Classification Search
CPC ..... B21D 37/12; B21D 37/02; B21D 37/04; B21D 37/10; B21D 37/08; B21D 37/14; B21D 22/10

(Continued)

(56) References Cited

U.S. PATENT DOCUMENTS 2,346,297 A 4/1944 Garbe
2,487,233 A 11/1949 Gerke (Continued)

OTHER PUBLICATIONS

Sankyo Oilless Industry, Inc., "Die Components," Catalog, Front cover, Index and Back cover, publication date unknown, 3 pages total, Sterling Heights, Michigan, USA.

(Continued)

*Primary Examiner* — David B Jones
(74) *Attorney, Agent, or Firm* — Price Heneveld LLP

(57) ABSTRACT

A guided keeper assembly for metal forming dies includes a base having a mounting face and a fastener aperture to mount the base to an associated die shoe, as well as a central guide aperture. A guide pin having a central portion is closely received in the central guide aperture for precisely guiding reciprocal motion between the die pad and the die shoe. The guide pin has an enlarged head at one end which abuts the base to positively limit travel between the die shoe and the die pad, and a shoulder at an opposite end with an alignment mechanism that precisely locates the guide pin on the die pad. A fastener extends through the fastener aperture in the base to securely connect the same with the die shoe. Another fastener securely connects the second end of the guide pin with the die pad.

20 Claims, 4 Drawing Sheets

Related U.S. Application Data continuation of application No. 13/311,831, filed on Dec. 6, 2011, now Pat. No. 8,522,595, which is a continuation of application No. 13/114,208, filed on May 24, 2011, now Pat. No. 8,074,486, which is a division of application No. 12/762,400, filed on Apr. 19, 2010, now Pat. No. 7,950,262, which is a continuation of application No. 11/515,477, filed on Sep. 1, 2006, now Pat. No. 7,730,757.

(51) Int. Cl.

| | |
|---|---|
| ***B21D 37/02*** | (2006.01) |
| ***B21D 37/08*** | (2006.01) |
| ***B21D 37/10*** | (2006.01) |
| ***B21D 22/10*** | (2006.01) |
| ***B21D 37/14*** | (2006.01) |

(52) U.S. Cl.
CPC ..... *B21D 37/08* (2013.01); *B21D 37/10* (2013.01); *B21D 37/14* (2013.01)

(58) Field of Classification Search
USPC ..... 72/456
See application file for complete search history.

(56) References Cited

U.S. PATENT DOCUMENTS

| | | | | |
|---|---|---|---|---|
| 2,627,313 | A | 2/1953 | Marsillius | |
| 2,629,615 | A | 2/1953 | Marsillius | |
| 2,663,160 | A | 12/1953 | Benedict | |
| 2,979,004 | A | 4/1961 | Kenville et al. | |
| 3,386,781 | A | 6/1968 | Blazek et al. | |
| 3,474,656 | A | 10/1969 | Kraft | |
| 3,514,166 | A | 3/1970 | Coley | |
| 3,568,555 | A | 3/1971 | Stroh | |
| 3,664,258 | A | 5/1972 | Vecchi | |
| 3,730,039 | A | 5/1973 | Fedrigo | |
| 3,897,118 | A | 7/1975 | Wolfthal | |
| 4,003,283 | A | 1/1977 | Janiszewski | |
| 4,080,819 | A | 3/1978 | Hook et al. | |
| 4,135,770 | A | 1/1979 | Doherty et al. | |
| 4,199,313 | A | 4/1980 | Bohnenberger | |
| 4,282,736 | A | 8/1981 | Mashburn | |
| 4,326,402 | A | 4/1982 | Wallis | |
| 4,483,173 | A | 11/1984 | Duhamel | |
| 4,696,180 | A | 9/1987 | Zandel | |
| 4,732,033 | A | 3/1988 | Smedberg et al. | |
| 4,742,746 | A | 5/1988 | Olsson | |
| 4,765,227 | A | 8/1988 | Balazs et al. | |
| 4,796,460 | A | 1/1989 | Smedberg et al. | |
| 4,836,071 | A | 6/1989 | Ersoy | |
| 4,930,334 | A | 6/1990 | Buehler et al. | |
| 5,113,736 | A | 5/1992 | Meyerle | |
| 5,243,743 | A | 9/1993 | Peterson | |
| 5,245,904 | A | 9/1993 | Meyerle | |
| 5,722,280 | A | 3/1998 | Bodnar | |
| 5,775,212 | A | 7/1998 | Takao | |
| 5,788,903 | A | 8/1998 | Allgaier | |
| 5,974,852 | A | 11/1999 | Nieschultz | |
| 6,408,728 | B1 | 6/2002 | Tsuji et al. | |
| 6,848,290 | B2 | 2/2005 | Pyper et al. | |
| 6,895,797 | B2 | 5/2005 | Lowry et al. | |
| 6,925,922 | B2 | 6/2005 | Manabe et al. | |
| 6,986,273 | B2 | 1/2006 | Rager | |
| 7,000,446 | B2 | 2/2006 | Nieschulz et al. | |
| 7,004,007 | B2 | 2/2006 | Kruger et al. | |
| 7,114,365 | B2 | 10/2006 | Rooney, Jr. et al. | |
| 7,152,451 | B1 | 12/2006 | Cotter | |
| 7,730,757 | B2 | 6/2010 | Pyper et al. | |
| 7,861,569 | B2 | 1/2011 | Cotter et al. | |
| 7,950,262 | B2 | 5/2011 | Pyper et al. | |
| 8,074,486 | B1 | 12/2011 | Pyper et al. | |
| 8,151,619 | B2 | 4/2012 | Pyper et al. | |
| 8,522,595 | B2 | 9/2013 | Pyper et al. | |
| 8,910,502 | B2 * | 12/2014 | Breen | B21D 37/10 72/344 |
| 8,919,178 | B2 * | 12/2014 | Breen | B21D 37/12 72/344 |
| 9,221,092 | B2 * | 12/2015 | Pyper | B21D 37/04 |
| 9,248,491 | B2 * | 2/2016 | Breen | B21D 37/12 |
| 9,272,321 | B2 * | 3/2016 | Breen | B21D 37/12 |
| 10,035,180 | B2 * | 7/2018 | Breen | B21D 37/12 |
| 2002/0124706 | A1 | 9/2002 | Mochizuki | |
| 2007/0037434 | A1 | 2/2007 | Fedder et al. | |
| 2009/0193665 | A1 | 8/2009 | Pyper et al. | |
| 2009/0193865 | A1 * | 8/2009 | Pyper | B21D 37/02 72/60 |
| 2016/0107218 | A1 * | 4/2016 | Breen | B21D 37/12 72/470 |

OTHER PUBLICATIONS

Sankyo Oilless Industry, Inc., "Index," Catalog, Sections A-1, A-2, Index, Front and Back covers and pp. 3, 15, 20, 23 and 24, publication date unknown, 7 pages total, Sterling Heights, Michigan, USA.

Sankyo Oilless Industry, Inc., "Features and Application of Sankyo Products," Catalog, Section A-3, Front and Back covers, and pp. 3-5, 8, 9, and 27, publication date unknown, 8 pages total, Sterling Heights, Michigan, USA.

Sankyo Oilless Industry, Inc., "Bushings," Catalog, Section C, Index, Front and Back covers, and pp. 3-24, publication date unknown, 26 pages total, Sterling Heights, Michigan, USA.

Sankyo Oilless Industry, Inc., "Lifters," Catalog, Section F, Front and Back covers and pp. 3-11, publication date unknown, 11 pages total, Sterling Heights, Michigan, USA.

Sankyo Oilless Industry, Inc., "Guide Post Sets," Catalog, Section J, Front and Back covers and pp. 3-22, publication date unknown, 24 pages total, Sterling Heights, Michigan, USA.

Sankyo Oilless Industry, Inc., "Standard Components for Press Die 2004-2005," Catalog, Front cover and pp. 2-4, publication date unknown, 4 pages total, Sterling Heights, Michigan, USA.

Sankyo Oilless Industry, Inc., "Die Guide Components," Catalog, Front and Back covers and pp. 69-134, 1601, 1602, 1660, 1665 and 1672, publication date unknown, 39 total sheets, Sterling Heights, Michigan, USA.

Dadco, Inc., "Dadco Micro Nitrogen Gas Lifter SLN.090," Bulletin No. B04101A, Front and Back covers, and pp. 2-3, publication date unknown, 4 pages total, Plymouth, Michigan, USA.

Dadco, Inc., "Dadco Market Research Customer Questionnaire, Proposed Product: Micro 180 ™ Nitrogen Gas Lifter," pubiication date unknown, 2 pages total, Plymouth, Michigan, USA.

Dadco, Inc., "Invoice ID 05-517152," and "Invoice ID 05-518671," Invoice, publication date unknown, 4 pages total, Plymouth, Michigan, USA.

Fibro, "Neue Produkte im Fibro-Normalien-Katalog '98," Catalog, Front cover, 4 pages unnumbered, pp. D33 and D67, Rear Index, publication date unknown, 10 pages total, city/country of publication unknown.

Daimler Chrysler, Die Engineering Standards—Guiding, Retaining & Heeling; Die Standards, pp. 1-8 and 35-39, publication date unknown, 13 pages total, city/country of publication unknown.

Steinel Normalien, Fuhrungsbuchsen Din 9831/ISO 9448, pp. 3.02, 3.03, 3.17, 3.21-3.23, 3.34-3.36, 3,46-3.54, 3.66, Rear cover, publication date unknown, 21 pages total, Villingen-Schwenningen, Germany.

Indaya SL, "Guide Post Bushing," Catalog, pp. F16 and F17, publication date unknown, 2 pages total, Zamadie (Vizcaua), Espana.

Dadco, Inc., "Dadco Nitrogen Gas Springs-90 Series-vol. II," Catalog 95C100, Front cover and p. 5, publication date unknown, 2 pages total, Plymouth, Michigan USA.

Dadco, Inc., "Dadco Nitrogen Gas Springs—"NH" Series," Catalog 92C124, Front cover and p. 9, publication date unknown, 2 pages total, Plymouth, Michigan USA.

(56) References Cited

OTHER PUBLICATIONS

Daimler Chrysler, "Die Engineering Standards—Guiding, Retaining & Heeling," Die Standards, p. 40, publication date unknown. 1 page total, city/country of publication unknown.
Associated Spring Raymond-Barnes Group Inc., "Raymond Nitrogen Gas Springs and Accessories," Catalog front cover, pp. 6, 7, 11, 12, 16, 22, 23 and Rear cover, publication date unknown, 9 pages total, Maumee, Ohio, USA.
Kaller, "Kaller-MC2Mounts," Catalog, p. 2.4/7, publication date unknown, 1 page total, Tronas, Sweden.
Kaller/Ogihara, "SF (SFC)/SFX," Catalog, pp. 51 and 52, publication date unknown, 2 pages total, city/country of publication unknown.
ISO, "International Standard—ISO 11901-2:2004(E)," International Standard, Part 2, sections 1, 2 and 3.4-3.4.3, publication date unknown, 4 pages total, city/country of publication unknown.
Kaller, "Kaley-CU 1000-1800 Mounts," Catalog, pp. 2.2/5, 2.3/3, 2.4/7, 3.1/2, publication date unknown, 4 pages total, Tranas, Sweden 7.
Kaller/Ogihara, "FSL-Gas Springs," Catalog, pp. 53, 55 and 61, publication date unknown, 3 pages total, city/country of publication unknown.
Dadco Inc., "Nitrogen Gas Spring Rail Lifter—SLC.800-7KN/3/4 ton," Bulletin B03109-SLC800, pp. 1 and 2, publication date unknown, Plymouth, Michigan, USA.
Power Components Inc., "Power Mite Cylinders," Catalog, Models 1000 and 1010, publication date unknown, 2 pages total, Dearborn, Michigan USA.
Indaya SL, "Retainer Bolt," Catalog, Front cover, pp. F-24, WO9 and Rear cover, publication date unknown, 4 pages total, Zamudio (Vizcaya), Espana.
Dadco Inc., "Dadco Nitrogen Gas Spring Two Post Lifter-SL2.090," Bulletin No. B05138, Front cover, pp. 2 and 3, Rear cover, publication date unknown, Plymouth, Michigan, USA.
Fibro, "Fibro 2032.70-2032.02," Catalog, p. 33, publication date unknown, 1 page total, city/country of publication unknown.
Fibro, "Fibro-Manifold-systems," Brochure, Front cover, two pages, Rear cover, publication date unknown, 4 pages total, city/country of publication unknown.

* cited by examiner

GUIDED KEEPER ASSEMBLY AND METHOD FOR METAL FORMING DIES

CROSS REFERENCE TO RELATED APPLICATIONS AND CLAIM TO PRIORITY

The present application is a continuation of commonly assigned U.S. patent application Ser. No. 13/954,498 filed Jul. 30, 2013 (now U.S. Pat. No. 9,221,092), which is a continuation of U.S. patent application Ser. No. 13/311,831 filed Dec. 6, 2011 (now U.S. Pat. No. 8,522,595), which is a continuation of U.S. patent application Ser. No. 13/114,208 filed May 24, 2011 (now U.S. Pat. No. 8,074,486), which is a divisional of commonly assigned U.S. patent application Ser. No. 12/762,400 filed Apr. 19, 2010 (now U.S. Pat. No. 7,950,262), which is a continuation of commonly assigned U.S. patent application Ser. No. 11/515,477 filed Sep. 1, 2006 (now U.S. Pat. No. 7,730,757), all of which are incorporated herein by reference and claim priority thereto under 35 U.S.C. § 120.

BACKGROUND OF THE INVENTION

The present invention relates to metal forming dies and the like, in particular, to a guided keeper assembly and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture and repair or modify.

FIGS. 4 and 5 illustrate a prior art metal forming die that includes a die shoe 1 and a die pad 2, which are interconnected for mutual reciprocation by a plurality of spools 3. A spring mechanism 4 is mounted between die shoe 1 and die pad 2, and resiliently urges die pad 2 to a fully extended position. A metal forming die 5 is mounted on the outer surface of die pad 2. Each of the spools 3 includes an enlarged head 6 which reciprocates in an associated counter bore 7 in the bottom of die shoe 1. The heads 6 of spools 3 engage the top of the associated counter bores 7 to positively retain die pad 2 in its fully extended position. The other ends 8 of spools 3 are attached to the corners of die pad 2. While such constructions have been generally successful, they do not precisely control reciprocation between die pad 2 and die shoe 1, particularly in high speed, progressive die applications.

FIGS. 6 and 7 illustrate another prior art configuration, wherein pressed in pins 10, with locator bushings 11, have been added to the spools 3 shown in FIG. 1 to more precisely control the reciprocation between die pad 2 and die shoe 1.

FIGS. 8 and 9 illustrate yet another prior art configuration, which includes guide pins 10 and bushings 11, but substitutes footed keepers 13 and 14 for the common spools 3 to positively limit the reciprocation between die pad 2 and die shoe 1. More specifically, footed keepers 13 are mounted to die pad 2, and engage mating footed keepers 14 which are mounted on die shoe 1.

While such prior art constructions are generally effective, they are complicated and expensive. A modular guided keeper which both precisely aligns the die shoe and die pad, and positively limits reciprocal travel therebetween would be clearly advantageous in simplifying metal forming die constructions and reducing the cost in designing, manufacturing, and repairing the same.

SUMMARY OF THE INVENTION

One aspect of the present invention is a metal forming die of the type having a die shoe, a die pad mounted a spaced apart distance from the die shoe for reciprocation between converged and diverged positions, and a biasing member disposed between the die shoe and the die pad for biasing the same to the diverged position. The metal forming die includes at least one guided keeper assembly, comprising a base block having a generally flat mounting face abutting an adjacent face of the die shoe, at least one fastener aperture extending axially through a marginal portion of the base block for detachably mounting the base block to the die shoe, a central aperture extending axially through a central portion of the base block, and a bushing mounted in the central aperture of the base block. The guided keeper assembly also includes a guide pin having a cylindrically-shaped central portion closely received in the bushing in the base block for precisely guiding reciprocal motion between the die pad and the die shoe, a first end having an enlarged head shaped to abut the mounting surface of the base block to positively limit travel between the die shoe and the die pad, and a second end, positioned opposite the first end, and having a shoulder with a rigid center post protruding outwardly therefrom to precisely locate the second end of the guide pin in the die pad. The guided keeper assembly also includes a first fastener extending through the fastener aperture in the base block and securely, yet detachably, connecting the base block with the die shoe, as well as a second fastener securely, yet detachably, connecting the second end of the guide pin with the die pad.

Another aspect of the present invention is a guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position. The guided keeper assembly includes a base block having a generally flat mounting face shaped to abut an adjacent face of the die shoe, at least one fastener aperture extending axially through a marginal portion of the base block for detachably mounting the base block to the die shoe, a central aperture extending axially through a central portion of the base block, and a bushing mounted in the central aperture of the base block. The guided keeper assembly also includes a guide pin having a cylindrically-shaped central portion closely received in the bushing in the base block for precisely guiding reciprocal motion between the die pad and the die shoe, a first end having an enlarged head shaped to abut the mounting face of the base block to positively limit travel between the die shoe and the die pad, and a second end, positioned opposite the first end, and having a shoulder with a rigid center post protruding outwardly therefrom to precisely locate the second end of the guide pin in the die pad. The guided keeper assembly also includes a first fastener extending through the fastener aperture in the base block and securely, yet detachably, connecting the base block with the die shoe, as well as a second fastener securely, yet detachably, connecting the second end of the guide pin with the die pad.

Yet another aspect of the present invention is a metal forming die of the type having a die shoe, a die pad mounted a spaced apart distance from the die shoe for reciprocation between converged and diverged positions, and a biasing member disposed between the die shoe and the die pad for biasing the same to the diverged position. The metal forming die also includes at least one guided keeper assembly, comprising a base block having a generally flat mounting face abutting an adjacent face of the die shoe, at least one fastener aperture extending axially through a marginal portion of the base block for detachably mounting the base block to the die shoe, and a central aperture extending axially through a central portion of the base block. The guided keeper assembly also includes a guide pin having a cylindrically-shaped central portion closely received in the central aperture of the base block for precisely guiding reciprocal motion between the die pad and the die shoe. The guide pin has a first end with an enlarged head shaped to abut the mounting face of the base block to positively limit travel between the die shoe and the die pad, and a second end, positioned opposite the first end, and having a shoulder with a center alignment aperture disposed concentrically in the shoulder, as well as an alignment pin having one end thereof mounted in the die pad, and an opposite end thereof closely received in the center alignment aperture on the guide pin shoulder to precisely locate the second end of the guide pin in the die pad. The guided keeper assembly also includes a first fastener extending through the fastener aperture in the base block and securely, yet detachably, connecting the base block with the die shoe, as well as a second fastener securely, yet detachably, connecting the second end of the guide pin with the guide pad.

Yet another aspect of the present invention is a method for making a metal forming die of the type having a die shoe, a die pad mounted a spaced apart distance from the die shoe for reciprocation between converged and diverged positions, and a biasing member disposed between the die shoe and the die pad for biasing the same to the diverged position. The method includes forming a base block with a generally flat mounting face shaped to abut an adjacent face of the die shoe, at least one fastener aperture extending axially through a marginal portion of the base block for detachably mounting the base block to the die shoe, and a central aperture extending axially through a central portion of the base block. The method further includes mounting a bushing in the central aperture of the base block. The method further includes forming a guide pin with a cylindrically-shaped central portion shaped for close reception in the bushing in the base block, a first end with an enlarged head shaped to abut the mounting face of the base block to positively limit travel between the die shoe and the die pad, and a second end with a shoulder and a rigid center post protruding outwardly therefrom. The method further includes forming a through hole in the die pad at a preselected location, and forming at least one fastener aperture in the die shoe at a preselected location. The method further includes inserting the central portion of the guide pin into the bushing in the base block for precisely guiding reciprocal motion between the die and the die shoe, and inserting a fastener through the fastener aperture in the base block and engaging the same in the fastener aperture of the die shoe to securely, yet detachably, mount the base block to the die shoe. The method further includes inserting the center post on the second end of the guide pin into the through hole in the die pad to precisely locate the second end of the guide pin in the die pad, and securely, yet detachably, connecting the second end of the guide pin with the die pad.

Yet another aspect of the present invention is to provide a metal forming die and associated guided keeper assembly that has a small, compact footprint, with a heavy-duty construction that is very durable. The guided keeper assembly has a modular configuration that facilitates economical manufacture, and also simplifies metal forming die constructions to reduce the effort and cost of designing, manufacturing, repairing and/or modifying the same. Machine downtime is also minimized to realize yet additional efficiency. The guided keeper assembly is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
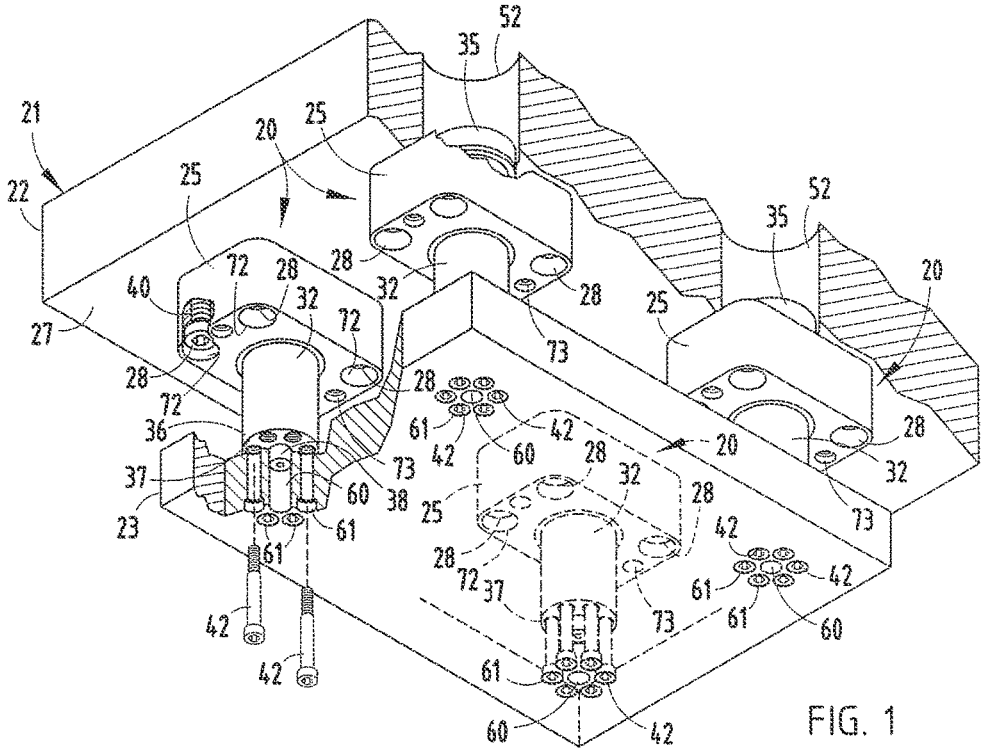
FIG. 1 is a perspective view of a die shoe and die pad interconnected by four guided keeper assemblies embodying the present invention, wherein portions of the die pad and die shoe have been broken away to reveal internal construction.
Figure 2:
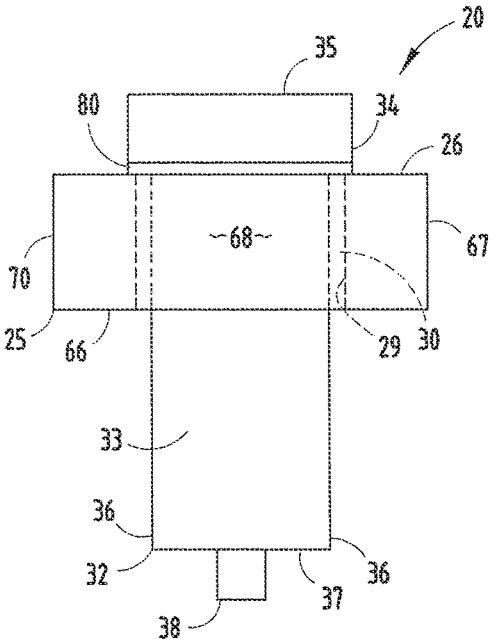
FIG. 2 is a side elevational view of one of the guided keeper assemblies embodying the present invention.

For purposes of description herein, the terms "upper," "lower," "right," "left," "rear," "front," "vertical," "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
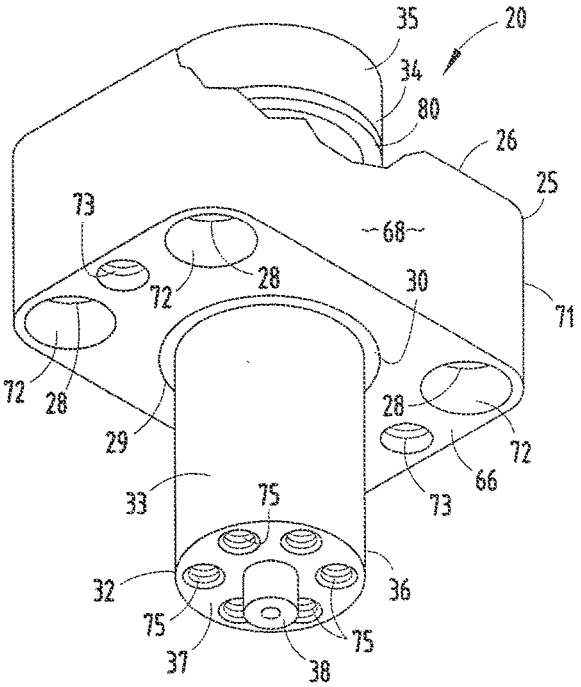
FIG. 3 is a bottom perspective view of the guided keeper assembly shown in FIG. 2, wherein a portion thereof has been broken away to reveal internal construction.
Figure 4:
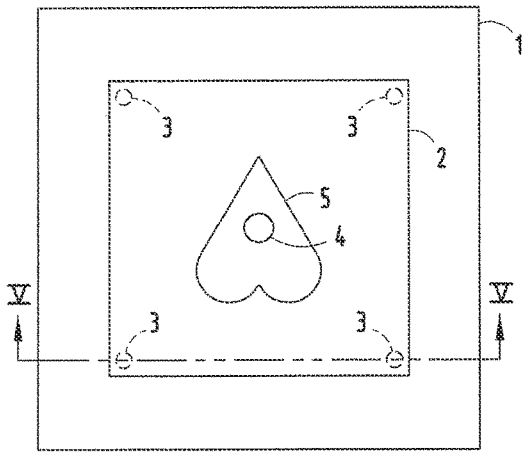
FIG. 4 PRIOR ART
FIG. 4 is a partially schematic plan view of a prior art metal forming die.
Figure 5:
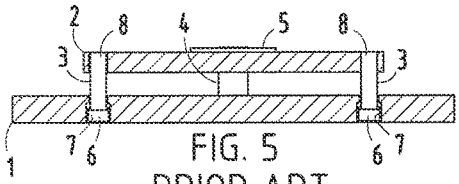
FIG. 5 PRIOR ART
FIG. 5 is a side cross-sectional view of the prior art metal forming die shown in FIG. 4.
Figure 6:
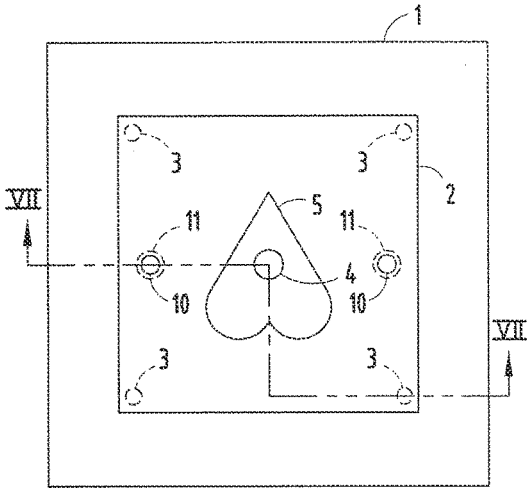
FIG. 6 PRIOR ART
FIG. 6 is a partially schematic plan view of an alternative prior art metal forming die.
Figure 7:
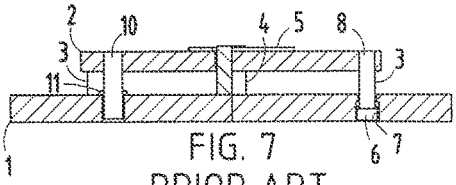
FIG. 7 PRIOR ART
FIG. 7 is a side cross-sectional view of the prior art metal forming die shown in FIG. 6.
Figure 8:
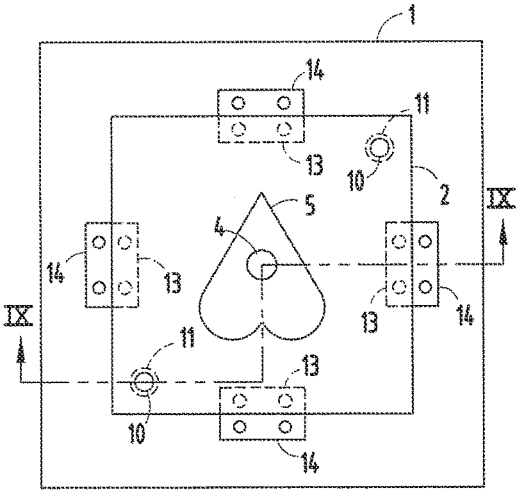
FIG. 8 PRIOR ART
FIG. 8 is a partially schematic plan view of yet another alternative prior art metal forming die.
Figure 9:
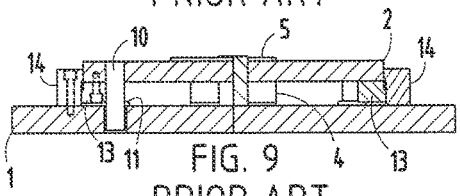
FIG. 9 PRIOR ART
FIG. 9 is a side cross-sectional view of the prior art metal forming die shown in FIG. 8.
Figure 17:
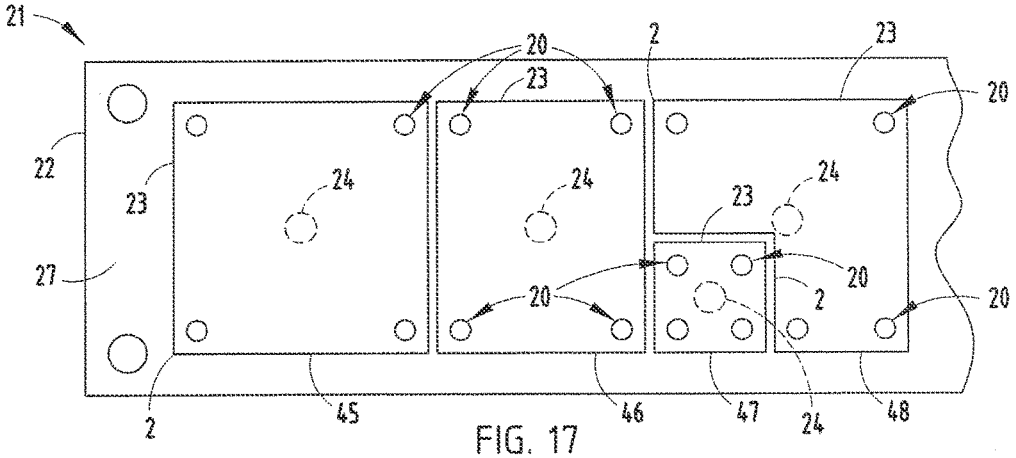
FIG. 17 is a partially schematic plan view of a metal forming die having a plurality of stations each with die pads connected to the die shoe by the guided keeper assemblies.
Figure 18:
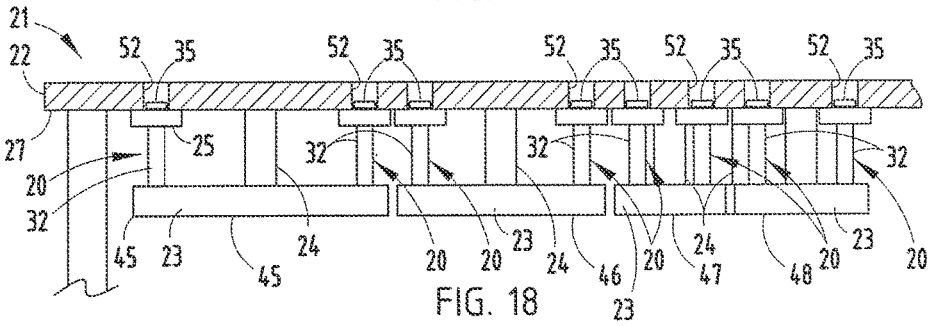
FIG. 18 is a partially schematic side cross-sectional view of the metal forming die shown in FIG. 17.
Figure 19:
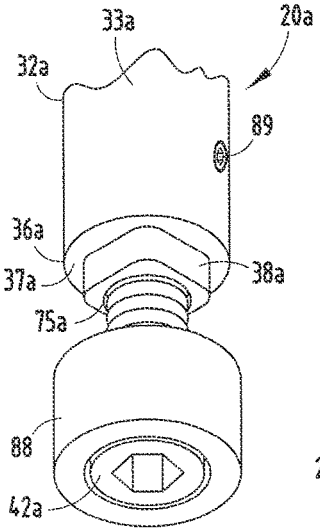
FIG. 19 is a fragmentary, perspective view of another embodiment of the present invention.

The reference numeral 20 (FIGS. 1-3) generally designates a guided keeper assembly embodying the present invention, which is particularly adapted for use in conjunction with metal forming dies, such as the die 21 illustrated in FIG. 1, having a die shoe 22 and a die pad 23 mounted a spaced apart distance from die shoe 22 for reciprocation between converged and diverged positions. A biasing member 24, which is schematically illustrated in FIGS. 17 and 18, is disposed between die shoe 22 and die pad 23 for biasing the same to the diverged position. Guided keeper assembly 20 (FIGS. 1-3) includes a base block 25 having a generally flat mounting face 26 abutting an adjacent face 27 of die shoe 22. Base block 25 has at least one non-threaded fastener aperture 28 extending axially through a marginal portion of base block 25 for detachably mounting base block 25 to die shoe 22. Base block 25 also includes a central aperture 29 extending axially through a central portion of base block 25, and a bushing 30 mounted in the central aperture 29 of base block 25. Guided keeper assembly 20 also includes a guide pin 32 having a cylindrically-shaped central portion 33 closely received in bushing 30 in base block 25 for precisely guiding reciprocal motion between die pad 23 and die shoe 22. Guide pin 32 also includes a first end 34 having an enlarged head 35 shaped to abut the mounting face 26 of base block 25 to positively limit travel between die shoe 22 and die pad 23. Guide pin 32 also includes a second end 36, positioned opposite the first end 34, and having a shoulder 37 with a rigid center post 38 protruding outwardly therefrom to precisely locate the second end 36 of guide pin 32 in die pad 23. A first fastener 40 extends through the fastener aperture 28 in base block 25 and securely, yet detachably, connects base block 25 with die shoe 22. A second fastener 42 securely, yet detachably, connects the second end 36 of guide pin 32 with die pad 23.

In the example illustrated in FIGS. 17 and 18, die 21 is an upper die half, and includes four separate stations 45-48, each having a separate die pad 23 attached to a common upper die shoe 22 by a plurality of guided keeper assemblies 20. In the illustrated example, each of the die pads 23 is attached to the common die shoe 22 by four guided keeper assemblies 20 disposed adjacent corner portions of the die pads 23. However, it is to be understood that the precise number of guided keeper assemblies and their particular location on the die pad 23 will vary in accordance with the particular application. Also, guided keeper assemblies 20 can be used on the lower die shoe, and other similar applications, as will be apparent to those skilled in the art.

Figure 10:
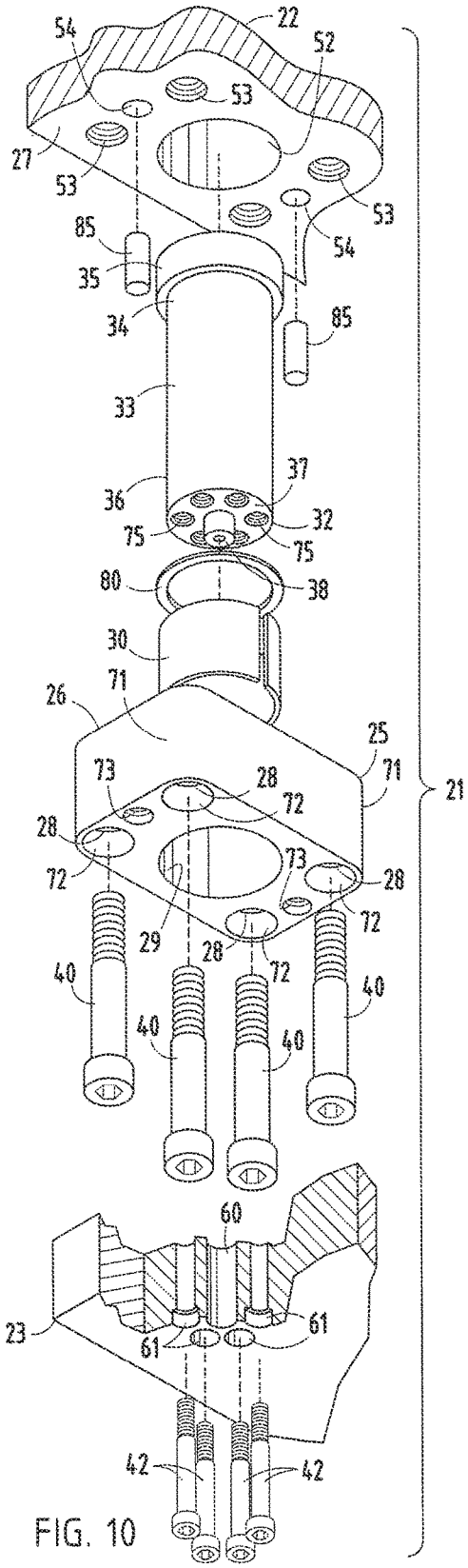
FIG. 10 is an exploded perspective view of the guided keeper assembly shown in FIGS. 1-3 with associated fragmentary portions of the die shoe and die pad.
Figure 11:
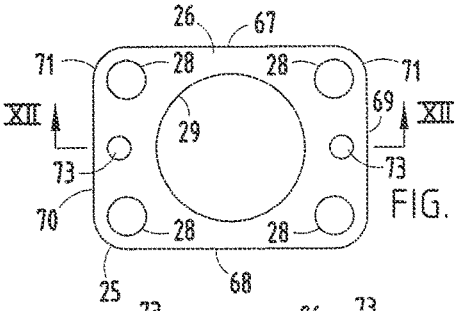
FIG. 11 is a top plan view of a base block portion of the guided keeper assembly.
Figure 12:
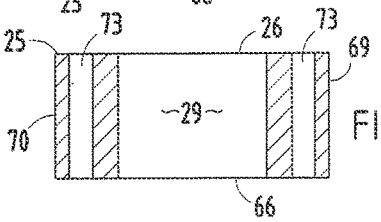
FIG. 12 is a vertical cross-sectional view of the base block taken along the line XII-XII, FIG. 11.
Figure 13:
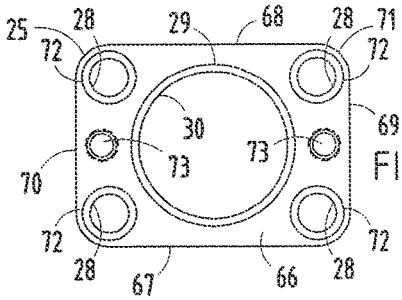
FIG. 13 is a bottom plan view of the base block.

As best illustrated in FIG. 10, at each position or location the guided keeper assembly 20 is to be installed, die shoe 22 is prepared in the following manner. A circular clearance or through hole 52 is formed through die shoe 22 in vertical axial alignment with the position at which the guided keeper assembly 20 is to be installed. Through hole 52 has a diameter slightly larger than the head 35 of guide pin 32 to permit free reciprocation of guide pin 32 therein. The formation of through hole 52 is relatively simple, since it can be formed in a single boring operation, and need not be precise, since there is substantial clearance between the head 35 of guide pin 32 and the interior of through hole 52.

In the example illustrated in FIG. 10, four threaded fastener apertures 53 are formed in the surface 27 of die shoe 22, and are arranged around through hole 52 in a quadrilateral pattern for purposes to be described in greater detail hereinafter. Also, in the embodiment illustrated in FIG. 10, two locator apertures 54 are formed in the surface 27 of die shoe 22 on opposite sides of through hole 52 to precisely locate base block 25 on die shoe 22 in the manner described in greater detail hereinafter. Preferably, locator apertures 54 are reamed to provide improved precision.

In the arrangement illustrated in FIG. 10, die pad 23 is prepared in the following manner. A precision circular locator aperture 60 is formed through die pad 23 at a position in vertical alignment with the location at which the guided keeper assembly 20 is to be installed. Locator aperture 60 is a through hole, and is formed with a precise diameter shaped through reaming or the like, to closely receive the center post 38 of guide pin 32 therein to accurately locate the second end 36 of guide pin 32 on die pad 23. In the illustrated example, six non-threaded fastener apertures 61 are formed through die pad 23, and are arranged in a circumferentially spaced apart pattern that is concentric with the locator aperture 60. Fastener apertures 61 have enlarged outer ends to receive the heads of fasteners 42 therein, and serve to securely, yet detachably, mount the second end 36 of guide pin 32 to die pad 23 in a manner described in greater detail hereinafter.

The illustrated base block 25 (FIGS. 10-13) is made from steel, and has a generally rectangular plan configuration defined by an upper surface 26, a lower surface 66 and sidewalls 67-70 which intersect at radiused corners 71. The illustrated base block 25 includes four non-threaded fastener apertures 28 positioned adjacent each of the corners 71 of base block 25. Fastener apertures 28 are mutually parallel and are arranged in a rectangular pattern identical to that of the threaded fastener apertures 53 on die shoe 22, such that fastener apertures 28 are in vertical alignment with threaded fastener apertures 53. The lower or die pad ends of fastener apertures 28 have enlarged counter-bored portions 72 to receive therein the heads of fasteners 40. The illustrated base block 25 also includes two locator apertures 73 which are formed through base block 25 and are arranged in a mutually parallel relationship for vertical alignment with the locator apertures 54 in die shoe 22. The illustrated base block 25 has a relatively small, compact plan configuration to facilitate die manufacture, and also permits the same to be pocketed or recessed into the die shoe 22, if necessary, for a specific application.

The illustrated bushing 30 (FIG. 10) is a maintenance-free split bushing, constructed from a suitable antifriction material, such as bronze, steel alloys or the like. In the uninstalled condition, the outside diameter of bushing 30 is slightly larger than the interior diameter of central aperture 29, such that hushing 30 is press fit into the central aperture 29 of base block 25 and is securely retained therein by a friction fit. The inside diameter of bushing 30 is slightly greater than the outside diameter of the central portion 33 of guide pin 32, such as 0.0010 0.0020 inches, to accommodate for thermal expansion between the guide pin 32 and the bushing 30, yet maintain precise reciprocal alignment between die shoe 22 and die pad 23.

As will be appreciated by those skilled in the art, bushing 30 may be formed integrally into base block 25, or omitted entirely by forming the hearing or guide surface for guide pin 32 in base block 25. For example, base block 25 could be constructed from bronze, or other similar antifriction materials, such that central aperture 29 itself forms the guide surface. Alternatively, the central aperture 29 of base block 25 can be plated or otherwise coated with an antifriction material to eliminate the need for a separate bushing 30.

Figure 14:
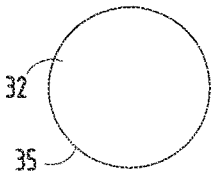
FIG. 14 is a top plan view of a guide pin portion of the guided keeper assembly.
Figure 15:
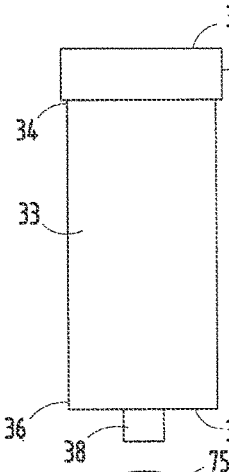
FIG. 15 is a side elevational view of the guide pin.
Figure 16:
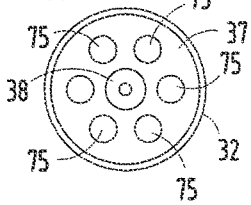
FIG. 16 is a bottom plan view of the guide pin.

The illustrated guide pin 32 (FIGS. 10 and 14-16) has a generally cylindrical shape, which in the orientation illustrated in FIGS. 14-16, has enlarged head 35 attached to the upper or first end 34 of guide pin 32 and center post 38 protruding downwardly from the lower or second end 36 of guide pin 32. The illustrated shoulder 37 and center post 34 are formed integrally in the lower end 36 of guide pin 32, and center post 37 is precisely located at the center of shoulder 37 in a concentric relationship. The lowermost end of the illustrated center post 38 is flat with a circular indentation at the center which facilitates precise location and formation of center post 38 on guide pin 32. The illustrated center post 38 is accurately machined to a tolerance of 0.0-0.0005 inches. In the example illustrated in FIGS. 10 and 14-16, six threaded fastener apertures 75 are formed in the flat, radially extending shoulder 37 of guide pin 32 in a circumferentially spaced apart pattern that is concentric with center post 38. Threaded fastener apertures 75 are positioned to align vertically with the six non-threaded fastener apertures 61 and die pad 23. In one working embodiment of the present invention, guide pin 32 is constructed from pre-hardened 4140 steel, or the like, is cut to length and formed, and then case hardened and polished.

With reference to FIG. 10, the illustrated guided keeper assembly 20 includes an annularly-shaped, resilient washer or ring 80 that is disposed on guide pin 32 between enlarged head 35 and the mounting face 26 of base block 25. Resilient washer 80 serves to absorb impact between head 35 and base block 25 during operation, and can be constructed from urethane, or the like.

In operation, guided keeper assemblies 20 are used to quickly and easily interconnect die shoe 1 and die pad 2 for reciprocation between converged and diverged positions. At least two guided keeper assemblies 20 are typically used to mount die pad 2 to die shoe 1. However, it is to be understood that the specific number of guided keeper assemblies 20 used depends upon the specific die application. In any event, the die shoe 1 is prepared in the manner described hereinabove by providing the clearance or through hole 52, four threaded fastener apertures 53 and two locator apertures 54 at each location at which guided keeper assembly 20 is to be installed. Similarly, die pad 2 is prepared by forming one locator aperture 60 and six unthreaded fastener apertures 61 at each location guided keeper assembly 20 is to be installed. The base blocks 25 are then mounted to the surface 27 of die shoe 22 at each of the designated locations by installed threaded fasteners 40 which are then inserted through fastener apertures 28 and anchored in the threaded fastener apertures 53 in die shoe 22. The illustrated fasteners 40 are cap screws with nylon pellets which resist inadvertent loosening in die shoe 22. Alignment dowels or pins 85 may be mounted in die shoe 22 and received in locator apertures 54 and 72 to achieve additional precision in locating base blocks 25 on die shoe 22. Guide pins 32, with resilient washers 80 installed thereon, are then inserted through the bushings 30 in each of the base blocks 25. The center post 38 at the lower end 36 of each guide pin 32 is received closely within the locator apertures 60 in die pad 23. Threaded fasteners 42 are then inserted through the fastener apertures 61 in die pad 23 and anchored in the threaded fastener apertures 75 in the shoulder portion 37 of guide pin 32 to securely, yet detachably, connect the lower end of guide pin 32 with die pad 23.

Figure 20:
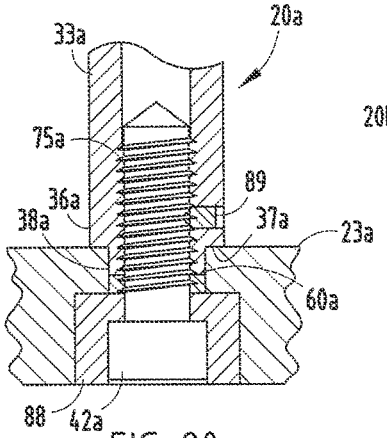
FIG. 20 is a fragmentary, vertical cross-sectional view of the guided keeper assembly shown in FIG. 19 shown attached to a die pad.
Figure 21:
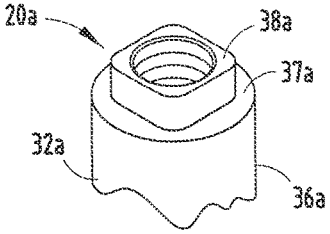
FIG. 21 is a fragmentary, top perspective view of a guide pin portion of the guided keeper assembly shown in FIGS. 19 and 20.

The reference numeral 20*a* (FIGS. 20-21) generally designates another embodiment of the present invention, having a single fastener 42*a* at the shoulder end 36*a* of guide pin 32*a*. Since guided keeper assembly 20*a* is similar to the previously described guided keeper assembly 20, similar parts appearing in FIGS. 20-21, 1-3 and 10-16, respectively, are represented by the same, corresponding reference numerals, except for the suffix "a" in the numerals of the latter. In guided keeper assembly 20*a*, the lower or shoulder end 36*a* of guide pin 32*a* includes a center post 38*a* having a non-circular plan configuration, which is designed to prevent rotation of guide pin 32*a* relative to the associated die pad 23*a*. In the illustrated example, the center post 38*a* of guide pin 32*a* has a generally square plan configuration with radiused or rounded corners. Furthermore, a single threaded fastener aperture 75*a* is formed concentrically through shoulder 37*a* and into guide pin 32*a*, and is adapted to receive therein a single threaded fastener 42*a* along with annularly-shaped cap or locking collar 88. A set screw 89 extends radially through the side of guide pin 32*a* to facilitate removal of base block 25*a*, and positively retain fastener 42*a* in threaded fastener aperture 75*a*. Die pad 23*a* is prepared with a non-circular locator aperture 60*a* to closely receive therein the center post 38*a* of guide pin 32*a* and prevent axial rotation therebetween.

Figure 22:
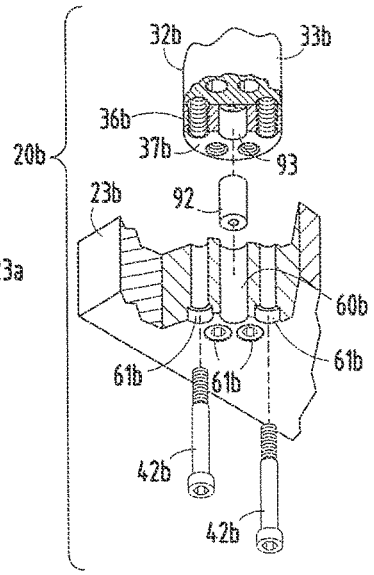
FIG. 22 is an exploded side elevational view of yet another embodiment of the present invention having an alignment pin connecting the guide pin with the die pad.

The reference numeral 20*b* (FIG. 22) generally designates yet another embodiment of the present invention having a removable locator pin 92 at the shoulder end 36*b* of guide pin 32*b*. Since guided keeper assembly 20*b* is similar to the previously described guided keeper assembly 20, similar parts appearing in FIG. 22, FIGS. 1-3 and 10-16, respectively, are represented by the same, corresponding reference numerals, except for the suffix "b" in the numerals of the latter. In guided keeper assembly 20*b*, a cylindrical recess 93 is formed in the end 37*b* of guide pin 32*b*, instead of center post 38*b*. In the illustrated example, recess 93 has a generally circular plan configuration, and is precisely formed in the center of the shoulder 37*b* of guide pin 32*b*. A mating through aperture 60*b* is formed through die pad 23*b* in vertical alignment with recess 93. A separate, cylindrical locator pin 92 has one end closely received in recess 93, and the opposite end closely received in locator aperture 60*b*, so as to precisely locate the shoulder end 36*b* of guide pin 32*b* in die pad 23*b*.

Guided keeper assemblies 20, 20*a* and 20*b* each provide a very effective, versatile, uncomplicated and inexpensive mechanism that both precisely aligns a die shoe with an associated die pad, and positively limits reciprocal travel therebetween.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. In a metal forming die having first and second die members mounted a spaced apart distance for reciprocation between converged and diverged positions, the improvement of a guided keeper assembly, comprising:

a base having:

a mounting face abutting an adjacent face of said first die member;

at least one first fastener aperture extending axially through a marginal portion of said base for detachably mounting said base to said first die member; and a central aperture extending axially through a central portion of said base;

a guide pin having:

a cylindrically-shaped central portion closely received in said base for precisely guiding reciprocal motion between said first and second die members;

wherein said central portion of said guide pin comprises a body having a circular lateral cross-sectional shape;

a first end having an enlarged head shaped to abut said base to positively limit travel between said first and second die members; and a second end, positioned opposite said first end, and having a shoulder with a center post protruding outwardly therefrom to precisely locate said second end of said guide pin on said second die member, and an annularly shaped portion that includes a second fastener aperture located a radially spaced apart distance from said center post, and oriented parallel with said center post;

wherein said center post is removably supported on said shoulder of said guide pin;

a first fastener extending through said first fastener aperture in said base and securely, yet detachably, connecting said base with said first die member;

a second fastener extending into and anchored in said second fastener aperture in said guide pin and securely, yet detachably, connecting said second end of said guide pin with said second die member;

a resilient washer disposed on said guide pin between said enlarged head and said base to absorb and dampen impact therebetween; and wherein said first die member includes an opening disposed in an aligned relationship with said base and sized larger than the size of said enlarged head of said guide pin to permit reciprocation of said enlarged head therein.

2. A metal forming die as set forth in claim 1, wherein: said base includes an integrally formed bearing surface.

3. A metal forming die as set forth in claim 2, wherein: said base is constructed from an antifriction material.

4. A metal forming die as set forth in claim 3, wherein: said base is constructed from a material comprising bronze.

5. A metal forming die as set forth in claim 1, wherein: said central aperture of said base is coated with an antifriction material.

6. A metal forming die as set forth in claim 1, wherein: said second die member includes a first face oriented toward said second end of said guide pin, and a second face oriented opposite said first face; and including a metal forming tool mounted on said second face of said second die member.

7. A metal forming die as set forth in claim 6, wherein: said first die member comprises an upper die shoe disposed vertically above and aligned with said second die member.

8. A metal forming die as set forth in claim 7, wherein: said shoulder on said guide pin includes a plurality of said second fastener apertures arranged in a circumferentially spaced apart relationship.

9. A metal forming die as set forth in claim 1, wherein: said base is a single piece.

10. A metal forming die as set forth in claim 9, wherein: said base is constructed from a single piece of material.

11. A metal forming die as set forth in claim 1, including: a bushing that is received in the central aperture of the base.

12. A metal forming die as set forth in claim 11, wherein: said bushing is received in a portion of said central aperture.

13. A metal forming die as set forth in claim 11, wherein: the inside diameter of said bushing is larger than the outside diameter of said central portion of said guide pin.

14. A guided keeper assembly for a metal forming die having first and second die members mounted a spaced apart distance for reciprocation between converged and diverged positions, comprising:

a base having:

a mounting surface shaped to abut an adjacent face of the first die member; and a central aperture extending axially through a central portion of said base;

a guide pin having:

a cylindrically-shaped central portion closely received in said base for precisely guiding reciprocal motion between the first and second die members;

a first end having an enlarged head shaped to abut said base to positively limit travel between the first and second die members; and a second end, positioned opposite said first end, and having a shoulder with a center post protruding outwardly therefrom to precisely locate said second end of said guide pin on the second die member, and an annularly shaped portion that includes a fastener aperture located a radially spaced apart distance from said center post;

a first threaded fastener securely, yet detachably, connecting said base with the first die member;

a second threaded fastener extending into and anchored in said fastener aperture in said guide pin and securely, yet detachably, connecting said second end of said guide pin with the second die member; and wherein the shanks of said first and second threaded fasteners are only partially threaded.

15. A guided keeper assembly as set forth in claim 14, including:

a bushing that is mounted in the central aperture of the base.

16. A guided keeper assembly as set forth in claim 14, wherein:

said base is a single piece.

17. A guided keeper assembly as set forth in claim 14, wherein:

said base is constructed from a single piece of material.

18. A guided keeper assembly as set forth in claim 14, wherein:

said central aperture of said base is coated with an antifriction material.

19. A guided keeper assembly as set forth in claim 14, wherein:

said central aperture is plated with an antifriction material.

20. A guided keeper assembly as set forth in claim 14, wherein:

multiple first and second threaded fasteners are used in said guided keeper assembly.

* * * * *